US005294887A

United States Patent [19]

Etzold

[11] Patent Number: 5,294,887

[45] Date of Patent: Mar. 15, 1994

[54] DEVICE FOR GENERATING A TRIGGER SIGNAL FROM IGNITION PULSES IN AN IGNITION SYSTEM

[75] Inventor: Peter Etzold, Ebersbach-Rosswaelden, Fed. Rep. of Germany

[73] Assignee: Robert Bosch GmbH, Stuttgart, Fed. Rep. of Germany

[21] Appl. No.: 938,133

[22] PCT Filed: Mar. 23, 1991

[86] PCT No.: PCT/DE91/00259

§ 371 Date: Oct. 5, 1992

§ 102(e) Date: Oct. 5, 1992

[87] PCT Pub. No.: WO91/15678

PCT Pub. Date: Oct. 17, 1991

[30] Foreign Application Priority Data

Apr. 4, 1990 [DE] Fed. Rep. of Germany ..... 4010839

[51] Int. Cl.[5] ..... F02P 17/00

[52] U.S. Cl. ..... 324/388; 324/391; 123/644

[58] Field of Search ..... 324/379, 388, 391, 392, 324/397, 402; 123/643, 644

[56] References Cited

U.S. PATENT DOCUMENTS

| | | | |
|---|---|---|---|
| 4,165,481 | 8/1979 | Wells et al. | 324/378 |
| 4,277,752 | 7/1981 | Dinkelacker et al. | 324/399 |
| 4,708,121 | 11/1987 | Everett et al. | 324/379 |
| 4,742,306 | 5/1988 | Everett et al. | 324/379 |
| 4,795,979 | 1/1989 | Kreft et al. | 324/379 |
| 5,134,987 | 8/1992 | Mayer et al. | 123/644 |

FOREIGN PATENT DOCUMENTS

| | | |
|---|---|---|
| 2443403 | 3/1976 | Fed. Rep. of Germany . |
| 2436162 | 5/1977 | Fed. Rep. of Germany . |
| 2811573 | 9/1979 | Fed. Rep. of Germany . |
| 3000874A1 | 7/1981 | Fed. Rep. of Germany . |
| 3706786C1 | 5/1988 | Fed. Rep. of Germany . |
| 2172115A | 9/1986 | United Kingdom . |
| 2172116A | 9/1986 | United Kingdom . |

*Primary Examiner*—Kenneth A. Wieder
*Assistant Examiner*—Christopher Tobin
*Attorney, Agent, or Firm*—Spencer, Frank & Schneider

[57] ABSTRACT

A device for generating a trigger signal from ignition pulses of an ignition system, in which each one of the ignition pulses occurring in the ignition system is represented regardless of whether the ignition process is suppressed or not. The device can be connected to an ignition system which has at least one ignition coil with a primary winding and at least one secondary winding, where the first terminal of the primary winding is connected to the first terminal of a voltage source and the second terminal of the primary winding is connected by means of a controllable switch with a second terminal of the voltage source. The device comprises a first detection circuit which is coupled to the second terminal of the primary winding for detecting ignition pulses, a short-circuiting circuit for short-circuiting the primary winding, a second detection circuit for detecting ignition pulses occurring during suppression, and a combining circuit for combining the signals from the first and the second detection circuit in order to produce the trigger signal as an output.

8 Claims, 1 Drawing Sheet

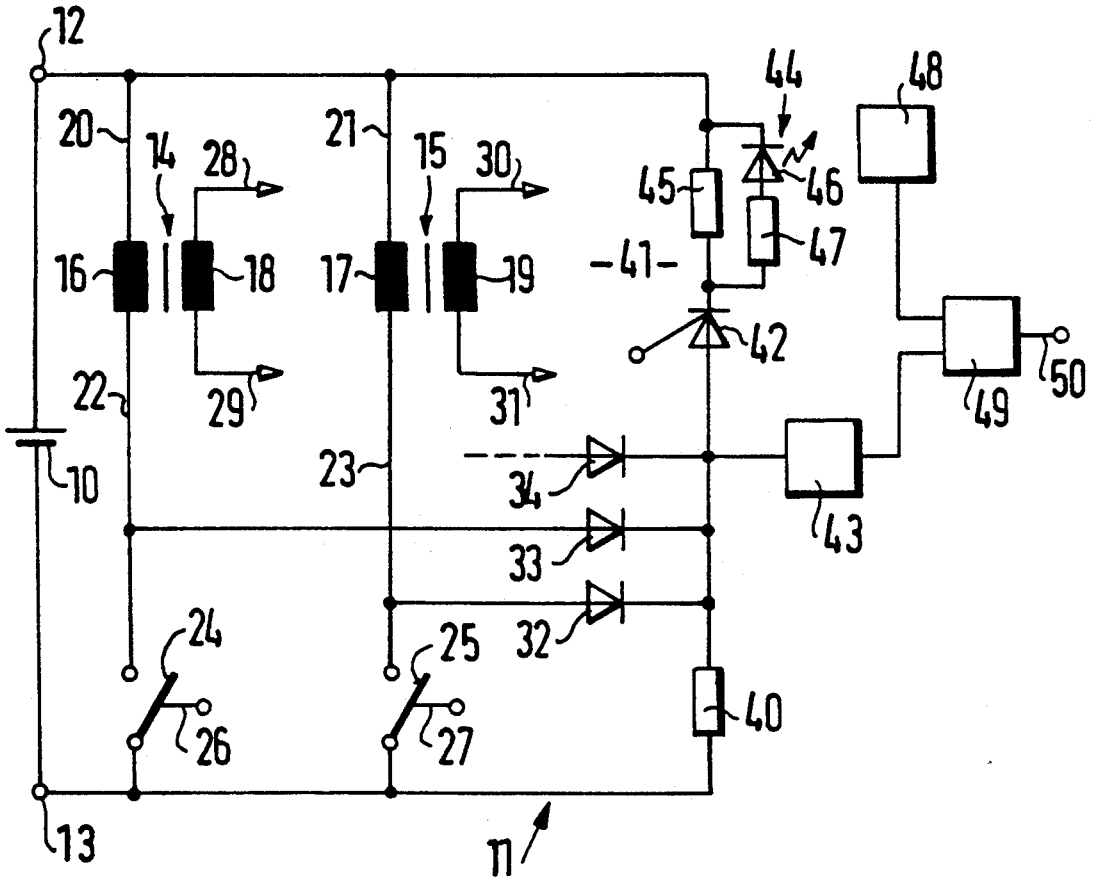
12
20
14
28
21
15
30
44
48
45
46
47
16
18
17
19
41
42
22
29
31
49
50
10
23
34
43
33
32
24
25
40
26
27
13
11

DEVICE FOR GENERATING A TRIGGER SIGNAL FROM IGNITION PULSES IN AN IGNITION SYSTEM

BACKGROUND OF THE INVENTION

The invention relates to a device for generating a trigger signal from the ignition pulses of an ignition system, preferably in an internal-combustion engine. German Patent 2,443,403 discloses an ignition system which includes an ignition coil and an interrupt switch disposed in the primary circuit of the ignition coil. In order to influence the running behavior of an internal-combustion engine operated with an ignition system, a controllable switch is provided which together with an actuation switch device can be connected in parallel with the primary winding of the ignition coil and thus suppresses individual ignition processes in the internal-combustion engine. The suppression of individual ignition processes is employed, for example, for a compression check in the internal-combustion engine with utilization of the starter current or for performance and smooth engine run measurements. To be able, to easily associate the current with the individual cylinders for a compression check, a connected engine tester requires reliable information about each individual ignition pulse occurring in the ignition system, independently of whether the ignition pulse initiates an ignition process or not.

It is generally known in the art to derive a trigger signal corresponding to the ignition pulses from the primary of the ignition coil. The signals that can be picked up there have numerous interferences superposed on them and exhibit varying signal behavior as a function of initiated or suppressed ignition processes.

It is the object of the invention to provide a device for generating a trigger signal from ignition pulses of an ignition system in which each one of the ignition pulses occurring in the ignition system is represented.

SUMMARY OF THE INVENTION

The device according to the invention has the advantage that the trigger signal available at its output represents every ignition pulse occurring on the primary of an ignition coil independently of whether the ignition process for the internal-combustion engine is suppressed or not. Provided are first detection means that can be connected with the primary terminal of the ignition coil for detecting ignition pulses as well as second detection means that can be connected with a short-circuiting means for the primary winding of the ignition coil for detecting ignition pulses as well as an arrangement for combining the signals put out by the two detection means for making available a trigger signal that can be picked up at an output. The first detection means connected with the primary of the ignition coil detects primarily those ignition pulses which occur when ignition processes are permitted. The second detection means that are connectable with the short-circuiting means detect primarily those ignition pulses which occur when ignition processes are suppressed. The arrangement for combining the signals put out by the two detection means ensures that a trigger signal is available whenever an ignition pulse occurs.

A particular advantage of the device according to the invention is its simple adaptation to the ignition system. To connect the invention to the ignition system, it is merely necessary to provide two terminals in parallel with the primary of the ignition coil. These two terminals can simultaneously be employed to connect the short-circuiting means to the ignition system.

The device according to the invention is suitable for connection to different ignition systems such as, for example, conventional coil ignitions, electronic ignitions and distributor-less single and multi-function ignitions.

The first detection means which are contacted with the primary of the ignition coil advantageously include a voltage comparator which emits a signal if a predetermined threshold voltage is exceeded. The threshold is preferably tuned to the oscillations that occur on the primary side during an ignition process.

The second detection means which are connected with the short-circuiting means advantageously include a current sensor and a comparator which puts out a signal if a predetermined current threshold is exceeded. The current threshold is advantageously tuned to the current to be expected in the short-circuiting means once the short-circuiting means has been actuated in order to suppress an ignition process.

In the simplest case, the current sensor is an ohmic resistor, with a positive temperature coefficient resistor being particularly suitable. In that case, a light-emitting diode is particularly suitable as a current detector. The diode is activated if a predetermined voltage drop across the current sensor is exceeded. The light-emitting diode is preferably a component of an optocoupler which has the advantage of being galvanically separated from the reminder of the evaluation circuit.

The arrangement for combining the signals put out by the two detection means can be realized in a particularly simple manner such as an OR linkage.

The device according to the invention is also suitable for multi-coil ignition systems. In each case, only a single additional connection must be made at the primary of each individual ignition coil. Diodes in particular are suitable as means for decoupling between the individual ignition coils.

Further advantageous features and improvements of the device according to the invention will become evident from the description.

BRIEF DESCRIPTION OF THE DRAWINGS

The sole drawing figure is a basic circuit diagram for a device according to the invention for generating a trigger signal from ignition for generating a trigger signal from ignition pulses of an ignition system.

DETAILED DESCRIPTION OF THE PREFERRED EMBODIMENTS

The drawing figure shows an ignition system 11 that is supplied with electrical energy from a voltage source 10. Voltage source 10 has a first and a second terminal 12, 13. Ignition system 11 includes two ignition coils 14, 15. Ignition coils 14,15 each have a primary winding 16, 17 as well as a secondary winding 18, 19. A first terminal 20, 21 of primary winding 16, 17 is connected in each case with the first terminal 12 of voltage source 10. A second terminal 22, 23 of ignition coil 14,15 can be connected in each case by way of a switch 24, 25 with the second terminal 13 of voltage source 10. Switches 24, 25 can be actuated by way of control means 26, 27 in a control device that is not shown in detail.

The secondary windings 18, 19 of ignition coils 14, 15 are connected with spark plugs 28, 29, 30, 31 which are associated with an internal-combustion engine that is not shown in detail. The drawing figure shows as an example a dual function ignition system in which each one of the two terminals of secondary windings 18, 19 is connected with spark plugs 28, 29; 30, 31.

The second terminals 22, 23 of primary windings 16, 17 are combined by way of diodes 32, 33. The drawing figure further shows a third diode 34 which leads to a further ignition coil not shown in the drawing. Diode 34 is shown as representative for any desired number of further diodes. An operating resistor 40 is disposed at the common connection point of diodes 32, 33, 34 and is connected with the second terminal 13 of voltage source 10. A short-circuiting means 41 is also connected with the common connection point and is able to produce a short-circuit toward the first terminal 12 of voltage source 10. Short-circuiting arrangement 41 is shown in the drawing by the switching symbol representing a thyristor. An actuating device not shown in detail for the short-circuit is connected to the control input 42 of the thyristor. Also connected to the common connection point of diodes 32, 33 34 and short-circuiting means 41 is a first detection means 43 for detecting ignition pulses that occur at the second terminals 22, 23 of primary windings 16,.17. Short-circuiting means 41 includes second detection means 44 for detecting ignition pulses that likewise occur at the second terminals 22, 23 and have an effect there once short-circuiting means 41 is actuated.

Second detection means 44 include a resistor 45 that acts as a current sensor and is connected in parallel with a series connection of a light-emitting diode 46 and a protective resistor 47. Light-emitting diode 46 together with a photoreceiver 48 constitutes an optocoupler for coupling out the signal.

The signals put out by the two detection means 43, 44 are fed to an arrangement 49 for combining the two signals. A trigger signal corresponding to every ignition pulse occurring in the ignition system is available at the output 50 of arrangement 49, independently of whether or not an ignition process is actuated at spark plugs 28, 29; 30, 31 of the internal-combustion engine.

The operation of the basic circuit shown in the drawing will now be described in greater detail:

Ignition system 11 is provided, for example, to initiate ignition processes in a non-illustrated internal-combustion engine. The ignition system may be of various designs. The drawing figure shows two ignition coils 14, 15. Only one ignition coil may be provided just as well, and more than two ignition coils may also be provided. Ignition coils 14, 15 are shown in the drawing as each having a separate primary winding 16, 17 and a secondary winding 18, 19. It is also possible to configure ignition coils 14, 15 as so-called autotransformers, in which case only one winding is provided which is equipped with a tap. In that case, the primary winding should advisably be called the low voltage winding and the secondary winding the high voltage winding. It is further possible for ignition coils 14, 15 to each have several secondary windings 18, 19 which lead to further spark plugs. In the illustrated example, two dual spark ignition coils are shown in which both terminals of secondary windings 18, 19 each lead to a pair of spark plugs 28, 29; 30, 31.

Ignition coils 14, 15 are actuated with the aid of controllable switches 24, 25. These switches may be mechanical interrupt contacts in a simple conventional coil ignition system. It is also possible for switches 24, 25 to be configured as semiconductor switches which are realized, for example, as end stage transistors in an electronic ignition device. In the case of a simple interrupt control, the control means 26, 27 for switches 24, 25 are mechanical cams and in the case of an electronic ignition system they are electronic components for actuating the semiconductor switches.

An ignition process at spark plugs 28, 29, 30, 31 occurs during the opening of switches 24, 25 at the end of a closing phase of predetermined duration For ignition system 11 to operate properly, further components are required, for example so-called ignition capacitors which, however, are of only subordinate significance for the device according to the invention and have therefore been omitted. After opening of switches 24, 25, a steep voltage rise, which may have amplitudes up to several 100 volts, occurs at each second terminal 22, 23 of primary windings 16, 17. This high voltage rise is particularly suitable for the derivation of trigger signals from the ignition pulses appearing at second terminals 22, 23. The first detection means 43 for detecting these ignition pulses therefore preferably include a voltage comparator whose switching threshold is tuned to this ignition pulse voltage at the primary. The switching threshold is set, for example, at 100V. If this threshold is exceeded, the voltage comparator puts out a pulse which coincides in time with the appearance of the ignition pulses at spark plugs 28, 2,9, 30, 31. Diodes 32, 33, 34 are provided to isolate the signals between the individual ignition coils 14, 15.

For certain measurements at the internal-combustion engine, for example compression measurements with the aid of the starter current and performance and smooth engine run measurements, the suppression of individual or several ignition actuations in succession is necessary. For this purpose, short-circuiting means 41 is provided which includes a controllable switch. The thyristor shown in the drawing is particularly suitable for this purpose. An actuation device is connected to the control input 42 of the thyristor to turn it on in each case at the correct moment in time and to thus short-circuit the primary circuit of ignition coil 14 or of ignition coil 15. During the existence of the short-circuit, the generation of a high primary voltage is prevented at the second terminals 22, 23. Under certain circumstances, the first detection means 43 might then not be able to detect every ignition pulse occurring at the second detection terminals 22, 23. Therefore, second means 44 are provided which are included in short-circuiting means 41.

The current flowing in primary windings 16, 17 during the closing phase of switches 24, 25 is returned, once switches 24, 25 have opened, by way of short-circuiting means 41 to the first terminal 12 of voltage source 10. This current has amplitudes of several amperes. The second detection means 44 preferably include a current sensor which is configured, for example, as an ohmic resistor 45. Particularly suitable is also a positive temperature coefficient resistor which performs a protective function for the thyristor. The current flowing in the short-circuit leads to a voltage drop across resistor 45 which can be evaluated with the aid of a further voltage comparator. Suitable, for example, is a light-emitting diode 46 which is connected in parallel with resistor 45 and emits a radiation as soon as its threshold voltage is exceeded. Resistor 47 limits the current flowing through light-emitting diode 46 and sets the operating point. Light-emitting diode 46 is preferably part of an optocoupler that includes a photoreceiver 48 which is integrated in a housing and cooperates with light-emitting diode 46. The second detection means 44 thus put out a signal upon the occurrence of ignition pulses at second terminals 22, 23 if a short-circuit is initiated simultaneously.

An arrangement 49 is provided to make available at its output 50 a trigger signal corresponding to every initiated ignition pulse independently of whether or not the initiation of an ignition process is suppressed. Arrangement 49 can be realized in a particularly simple manner such as an OR linkage. Arrangement 49 must ensure that either the signals put out by the first detection means 43 or the signals put out by the second detection means 44 or by both detection means 43, 44 reach output 50.

I claim:

1. A device connected to an ignition system for generating a trigger signal from ignition pulses of the ignition system, wherein the ignition system includes at least one ignition coil having a primary winding and at least one secondary winding, wherein a first terminal of the primary winding is connected with a first terminal of a voltage source and a second terminal of the primary winding is connected by a controllable switch with a second terminal of the voltage source, the device comprising:

a first detection means coupled to the second terminal of the primary winding for detecting ignition pulses and providing corresponding output signals, a controllable short-circuiting means, connected in parallel with the primary winding, for short-circuiting the primary winding, said controllable short-circuiting means including a second detection means for detecting ignition pulses occurring if ignition processes are suppressed, the second detection means including a current sensor for sensing short-circuit current of the primary winding and a comparator connected to the current sensor for providing output signals when the sensed short-circuit current exceeds a predetermined value, and a combining means for combining the output signals of the first and the second detection means in order to produce the trigger signal as an output.

2. A device according to claim 1, wherein the first detection means includes a voltage comparator.

3. A device according to claim 1, wherein the short-circuiting means further includes a controllable switch, and the current sensor is an electrical resistor connected in series with the controllable switch.

4. A device according to claim 3, wherein the current sensor is a positive temperature coefficient resistor.

5. A device according to claim 3, wherein: the comparator is a light-emitting diode connected in parallel with the electrical resistor, with said light-emitting diode being included in an optocoupler which contains a photoreceiver in addition to the light-emitting diode.

6. A device according to claim 1, wherein the combining means is an OR circuit.

7. A device according to claim 1, wherein a plurality of said ignition coils are provided, with the second terminal of each primary winding are decoupled from being connected by a respective diode to a common connection point with the short-circuiting means.

8. A device according to claim 3, wherein the controllable switch of the short-circuiting means is a thyristor.

* * * * *